US010633153B2

(12) United States Patent
Ruthe-Steinsiek

(10) Patent No.: US 10,633,153 B2
(45) Date of Patent: Apr. 28, 2020

(54) ADMINISTRATION UNIT FOR COMPOSITION

(71) Applicant: Henkel AG & Co. KGaA, Duesseldorf (DE)

(72) Inventor: Kai Ruthe-Steinsiek, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 13 days.

(21) Appl. No.: 15/244,286

(22) Filed: Aug. 23, 2016

(65) Prior Publication Data

US 2016/0355307 A1 Dec. 8, 2016

Related U.S. Application Data

(63) Continuation of application No. PCT/EP2015/053493, filed on Feb. 19, 2015.

(30) Foreign Application Priority Data

Feb. 25, 2014 (DE) ..... 10 2014 203 357

(51) Int. Cl.
*B65D 51/24* (2006.01)
*B65D 81/36* (2006.01)
*B65D 55/02* (2006.01)

(52) U.S. Cl.
CPC ..... *B65D 51/24* (2013.01); *B65D 55/02* (2013.01); *B65D 81/36* (2013.01); *B65D 2251/09* (2013.01)

(58) Field of Classification Search
CPC ..... B65D 51/24; B65D 55/02; B65D 81/36; B65D 2251/09
(Continued)

(56) References Cited

U.S. PATENT DOCUMENTS 749,486 A 1/1904 Huddle
4,144,983 A * 3/1979 Pauls ..... B05B 11/0008 215/216
(Continued)

FOREIGN PATENT DOCUMENTS

CA 993169 A 7/1976
CA 1229696 A 11/1987
(Continued)

OTHER PUBLICATIONS

International Search Report for International PCT Patent Application No. PCT/EP2015/053493 dated May 26, 2015.

*Primary Examiner* — James N Smalley
(74) *Attorney, Agent, or Firm* — James E. Piotrowski

(57) ABSTRACT

An administration unit for a composition comprising a container intended for accommodating the composition and having an opening and a cap for closing the opening. The cap has a projecting separating region to separate off a part of the composition. Mutually corresponding connection means are provided on the container and cap and allow the cap to be connectable to the container in a first storage position and a second separating position, wherein the cap is connectable to the container in the first storage position in such a manner that the opening is closed thereby and the separating region extends essentially along a container outer wall and wherein the cap is connectable to the container in the second separating position in such a manner that the separating region projects from the container, in order to allow a user to guide the separating region by means of the container.

18 Claims, 3 Drawing Sheets

(58) Field of Classification Search
USPC ..... 215/228, 246, 251, 253
See application file for complete search history.

(56) References Cited

U.S. PATENT DOCUMENTS

| | | | | | |
|---|---|---|---|---|---|
| 4,634,013 | A * | 1/1987 | Bar-Kokhba | B65D 51/223 | 215/228 |
| 4,693,410 | A * | 9/1987 | Selz | A47G 19/2205 | 229/400 |
| 5,090,582 | A * | 2/1992 | Art | B65D 51/225 | 215/226 |
| 5,148,937 | A * | 9/1992 | Huard | B65D 51/223 | 215/228 |
| 5,505,326 | A * | 4/1996 | Junko | B65D 51/223 | 206/222 |
| 6,039,198 | A * | 3/2000 | Wolfe | B65D 51/223 | 215/228 |
| 6,161,711 | A * | 12/2000 | Miceli | B65D 50/061 | 215/206 |
| 6,821,041 | B1 | 11/2004 | Hallam et al. | | |
| 2004/0173561 | A1 | 9/2004 | Wolfe | | |
| 2006/0191936 | A1* | 8/2006 | De Laforcade | B65D 51/223 | 220/278 |
| 2010/0038338 | A1* | 2/2010 | Berndt | B65D 51/22 | 215/257 |
| 2013/0243513 | A1 | 9/2013 | Batchvarova | | |
| 2019/0062012 | A1* | 2/2019 | Mathis | B65D 51/246 | |
| 2019/0168933 | A1* | 6/2019 | Jackson | B65D 51/246 | |

FOREIGN PATENT DOCUMENTS

| | | | |
|---|---|---|---|
| CN | 1408337 | A | 4/2003 |
| CN | 101927864 | A | 12/2010 |
| DE | 1965772 | A1 | 7/1971 |
| DE | 2322806 | A1 | 5/1974 |
| DE | 3210608 | A1 | 11/1982 |
| DE | 10050541 | A1 | 4/2002 |
| ES | 1067167 | U | 4/2008 |
| ES | 1071109 | U | 1/2010 |

* cited by examiner

ADMINISTRATION UNIT FOR COMPOSITION

The present invention relates to an administration unit for, in particular, kneadable compositions, in particular, a sealing and/or adhesive composition that can be produced by mixing, in particular, kneading from two or more components, wherein the components may contain different substances that preferably cure after being mixed together. Therein, the administration unit is used, in particular, to accommodate the composition and also to separate a portion of the composition.

Such kneadable compositions are known in many ways in the prior art. For example, DE1965772A1 discloses a cement composition having two different elongated parts that are in contact with one another over substantially the entire length on a surface extending in the longitudinal direction, wherein the one molding contains a reactive monomer and an unsaturated polyester resin that is formed by esterification of a diol with an unsaturated dicarboxylic acid and optionally a saturated dicarboxylic acid, in admixture with a one or more inorganic fillers, and the other molding contains a curing agent and one or more inorganic fillers, the curing agent being capable of curing the reactive monomers and unsaturated polyester resin of the first molding.

DE2322806A1 discloses a band-shaped, curable epoxy resin system composed of two strips lying next to one another over the whole length thereof, one of these strips comprising an uncured epoxy resin and the second strip comprising an agent for curing the epoxy resin that is dispersed in a carrier. Mention is also made of winding about a roll, as well as removal of a part of the band therefrom for the purpose of mixing.

DE3210608A1 also discloses a putty-like epoxy adhesive sealant comprising a first strip of an uncured epoxy resin composition and a second strip comprising a composition capable of quickly curing the uncured epoxy resin composition within about ten minutes from the time when the first and second strips are combined to form a substantially uniform mixture. This band can be extruded, rolled after the extrusion, and packaged in any desired manner.

In addition to the strip shape, it is also common to use a block or a cylinder of a kneadable composition, wherein a closable container is generally used for storage. When the kneadable composition is used, an arbitrary portion of the kneadable composition is separated off from the block or cylinder.

ES1067167U illustrates a further development of such a container for accommodating a kneadable composition in the form of a cylinder. The container is a hollow cylinder and composed of two halves, both halves being hinged together via a hinge at the one side. An end face then forms a cutting device that is fastened to one of the halves, but extends over the end face of this one half into the end-side region of the second half. For removal of the composition, the container can be opened by unfolding one half. For a part of the composition to be separated out, the composition is arranged such that the cutting device cuts into the composition when the container is closed anew, and separates out a part.

ES1071109U1 illustrates an administration unit composed of a container for accommodating a kneadable composition in the shape of a cylinder, and a cap for closing the container. The hollow cylinder has a dispensing opening that can be closed by means of the cap. For a part of the composition to be removed, the container is opened and an arbitrary part of the composition is separated out from the cylinder by means of a cutting blade molded onto the cap. Next, the remaining part of the composition can again be accommodated within the container.

The present invention addresses the problem of providing an improved administration unit for a kneadable composition that makes it easy to separate out a part of the kneadable composition.

This problem is solved by the features of claim 1.

Advantageous embodiments of the invention are set forth by the dependent claims.

The basic concept of the present invention is the use of an administration unit for a composition, in particular, a kneadable composition, comprising a container intended for accommodating the composition and having an opening and a cap for closing the opening, wherein the cap has a projecting separating region to separate off a part of the composition, characterized in that mutually corresponding connection means are provided on the container and cap and allow the cap to be connected to the container in both a first storage position and a second separating position, wherein the cap is connected to the container in the first storage position in such a manner that the opening is closed thereby and the separating region extends essentially along a container outer wall and in that the cap is connected to the container in the second separating position in such a manner that the separating region projects from the container, in order to allow the user a possibility of guiding the separating region via the container.

As the composition, it is possible to use, in particular, a kneadable composition such as, for example, a kneadable epoxy resin-based adhesive. Also conceivable are polyurethane synthetic resin systems or radical curing artificial resin systems. Such kneadable compositions may be used, for example, as fastening compositions in the field of construction, in particular, as adhesives for anchoring elements. In addition, voids and holes in a variety of materials can be repaired. Generally, such kneadable compositions comprise at least two components that are mixed together by kneading, in particular, in order to achieve a reaction for curing the composition.

Preferably, the kneadable composition in the present invention is designed so as to be cylindrical or block-shaped in a strand in such a manner that the components to be kneaded together exist one next to the other, one over the other, or a combination thereof, in particular, as a coextrudate. It is also conceivable to have a shape with which the one component surrounds the second one. Particularly preferably, the strand has the same ratio of components to one another, preferably over the entire length thereof in the section orthogonal to the longitudinal extension, in order to achieve a uniform formulation of the composition.

The container is preferably designed so as to be closed except for the opening. Preferably, the container has a longitudinal extension with a bottom side on one end face and the opening on the opposite end face. Preferably, the cross-section of the space defined by the container for accommodating the composition may then be uniform over the longitudinal extension. Optionally, the cross-section of the internal space from the opening to the bottom side may be slightly tapered. In particular, the container may have a circular, oval, trigonal, or polygonal cross-section; it is particularly preferable to use a hollow cylindrical container.

The cap then has a projecting separating region according to the present invention. For this purpose, preferably, the cap has a projecting surface portion that has a means for separating out a part of the composition—in particular, a sawing means or a cutting means—at least one side in the direction of extension as seen from the cap.

Furthermore, according to the present invention, the cap is designed so as to close the opening in the first storage position. Preferably, it may be possible to have a closing of the opening that is airproof and waterproof under normal conditions. For this purpose, preferably, the cap has a projecting region that protrudes partially through the opening into the space in the storage position. Said projecting region and, in particular, a margin delimiting the opening as well as, for example, regions of an inner wall of the container that is adjacent thereto and delimits the space are applicable as corresponding connection means according to the present invention. Alternatively or additionally, an overlap region may be provided, which overlaps the container and, in particular, the margin of the container that delimits the opening in such a manner as to make a seal possible. Said overlap region and, in particular, the margin delimiting the opening as well as, for example, regions of an outer wall or outer surface of the container that is adjacent thereto are applicable as corresponding connection means according to the present invention. Preferably, in all cases, mounting devices are provided, which enable a secure hold of the cap onto the container in the storage position. These mounting devices may provide a connection by means of positive or non-positive locking, for example, in the form of clamping or snapping connection means.

In said storage position, according to the present invention, the opening is closed and the separating region extends essentially along a container outer wall. Preferably, the separating region then abuts at least partially against the container outer wall and/or the projecting separating region extends essentially parallel to the container axis. In this manner, it is possible, for example, to reduce the risk of injury to the user or damage to other parts due to the separating region in the storage position.

Also provided according to the present invention are connection means that enable a separating position of the cap that is distinct from the storage position. It would be conceivable here to use the connection means of a structural element—namely, of the container of the cap—for both the storage position and the separating position, wherein the other member must in this case have different connection means. Preferably, in all cases, mounting devices are provided, which enable a secure hold of the cap onto the container in the storage position. These mounting devices may provide a connection by means of positive or non-positive locking, for example, in the form of clamping or snapping connection means.

In said separating position, according to the present invention, the separating region sticks or juts out from the container, so as to enable the possibility of engaging the separating region with the composition having been removed from the container. Preferably, the separating region then juts out from the container in the longitudinal extension and/or essentially parallel to a container axis, in particular, with a hollow cylindrical container. Optionally, it is conceivable to have an angled extension, in particular, an essentially rectangular extension of the separating region away from the container. It shall be readily understood here that it would also be conceivable for the cap to again close off the opening in the separating position. The aim of providing said separating position is to provide the user—in particular, through the container itself—with the ability to handle the administration unit so as to easily be able to separate out a part of the composition, in particular, by using the container as a handle for when the separating region is being used.

In a preferred embodiment, therefore, the connection means for the second separating position are provided by one of the end faces of the container as well as by a mounting section of the cap configured so as to correspond to the respective end face. With this design, in a suitable configuration, the user is able to use large parts of the container as a handle in order to separate out a part of the composition with said separating region.

Therein, it has proven especially advantageous for the mounting section to comprise a shape that corresponds to the opening, the mounting section preferably being designed so as to be insertable into the opening. For example, the opening may have a circular or oval cross-section, wherein the space preferably has the same cross-section. In this case, in this preferred embodiment, the mounting section would have at least partially a corresponding circular or oval cross-section, wherein the size of the mounting section is then smaller so as to allow the user to insert the mounting section into the opening. Nevertheless, in an alternative embodiment, it may also prove useful for the mounting section to be sheath-like, so as to be pushed onto an end face, for example, onto a bottom side of the container that lies opposite to the opening.

In an advantageous embodiment, the cap—in particular, on the mounting section thereof—or the container has fastening means in order to provide a positive- and/or non-positive-locking connection between the cap and the container in the second separating position. The fastening means may be, in particular, suitable snap or clamping connection means or regions that would be known to a person skilled in the art.

In a preferred embodiment, the mounting section is equipped with a combining aid and thus has an, in particular, funnel-shaped or tapered design so as to facilitate a connection of the mounting section and the corresponding end face of the container. With the embodiment described above, in which the mounting section can be inserted into the opening, the mounting section may, in particular, open out into a rounded or beveled region, in order to facilitate insertion of the mounting region into the opening. Correspondingly, the container may be equipped with a combining aid on the respective end face thereof provided for the connection. This may be, for example, a bevel or a rounding-off that makes it easier to introduce the mounting aid through the opening into the space of the container.

In an advantageous embodiment, the cap has a stop means or delimiting means, in order to delimit the combining of the cap and container to provide the separating position. In particular, provided is a stop means that is arranged and configured so as to delimit the insertion of the mounting section into the opening of the container.

In an advantageous embodiment, a protection section is provided, which covers the separating region or similarly protects against external engagement, in particular, in order to provide the ability to protect during non-use.

In a preferred embodiment, the separating region is designed out of plastic, wherein the protection section is molded onto the separating region and can be removed by the user prior to use of the separating region. It may then prove advantageous to produce the separating region together with the cap in an injection molding process, wherein the protection section is injection-molded onto the separating region.

An embodiment of an administration unit according to the present invention for, in particular, a kneadable composition is depicted with the accompanying drawings. Therein, FIG. 1 illustrates a perspective view of an administration unit according to the present invention, in the storage position;

Figure 1:
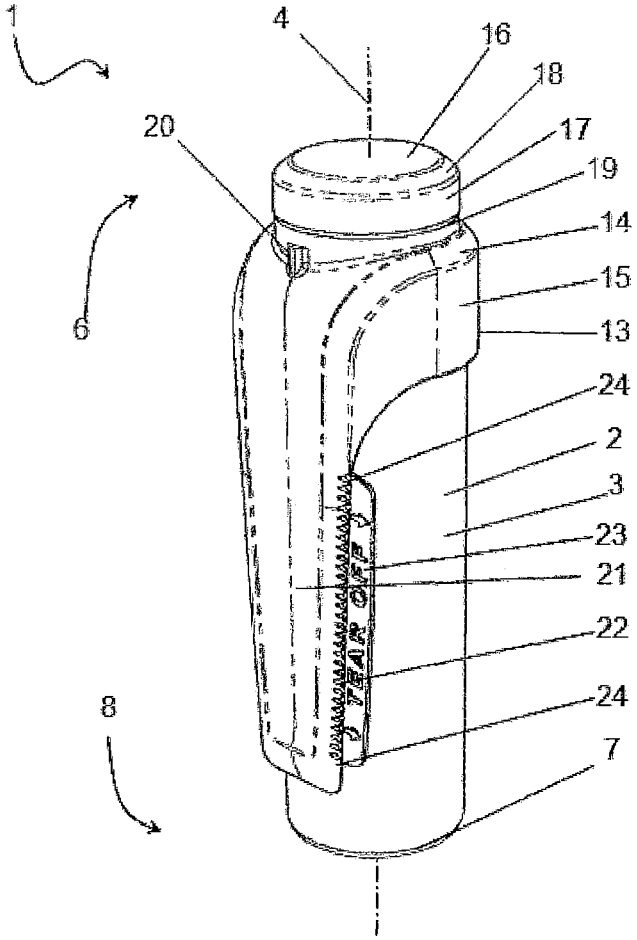

FIG. 1 illustrates a perspective view of an administration unit 1 according to the present invention, in the storage position. The administration unit 1 comprises a cylindrical container 2 with an axis 4, which contains a composition. A kneadable epoxy resin-based adhesive is used as the composition, the composition being cylindrical and in the shape of a strand in such a manner that the one component surrounds the second. The composition is not shown in the embodiment illustrated, because the container 3 has an opaque outer surface 3 that cannot be seen through. At one end face thereof, on a proximal underside 8, the container 2 has a bottom 7. On the opposite end face, a distal upper side 6, the container 2 is designed so as to be open, wherein in the reproduced storage position of the administration unit 1, a cap 13 closes the container 2 and thus protects the composition arranged within the container 2 against environmental influences. The cap 13 does not only provide the ability to easily close the container 2 in the sense of merely covering therefor. Rather, the cap has an overlap region 15 with which the cap partially surrounds the outer surface 3 on the upper side 6, and thus the cap 13 also provides protection or reinforcement of the container 2 on the upper side 6. The overlap region 15 transitions into a cylindrical collar region 19 with a curvature 14 in the distal direction, the collar region representing a region with a smaller diameter with respect to the overlap region 15. A nose-shaped stop element 20 projects radially out from the collar region 19, with respect to the axis 4. Further in the distal direction, the cap 13 has an also-cylindrical mounting section 17 that has a slightly greater diameter than that of the collar region 19, and is connected to the collar region 19 via a step. The mounting section 17, in turn, opens into a covering surface 16 in the distal direction with a bevel 18 that is later to also be used as a combining aid.

On the side opposite the covering surface 16, the cap 13 has a surface portion 21 that extends in the proximal direction parallel to the axis 4 and immediately adjacent to the outer surface 3. The surface portion 21 is equipped with a laterally projecting sawing region 22, as a separating region, which is covered in the embodiment depicted by means of a protection section designed as a securing strip 23 connected to the sawing region 22 via two connecting regions 24, in order to prevent engagement on the sawing region 22. Both the cap 13 and the container 2 are produced from plastic in the embodiment depicted. In particular, it may prove to be appropriate to then produce the cap 13 by means of an injection molding process, wherein the securing strip 23 is injection-molded onto the cap 13 over the connecting regions 24.

Figure 2:
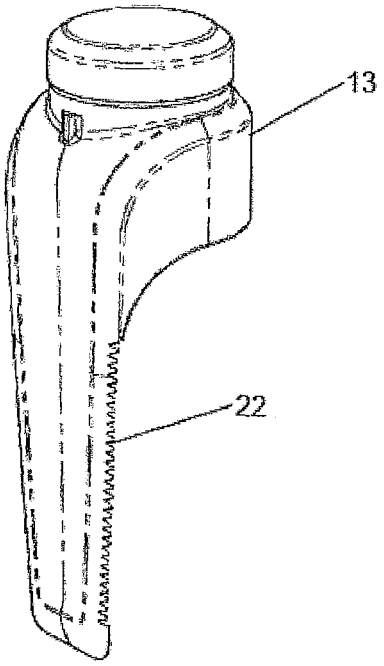
FIG. 2 illustrates a perspective view of the cap of the administration unit from FIG. 1.

FIG. 2 illustrates a perspective view of the cap 13 of the administration unit 1 from FIG. 1. For the composition to be removed from the container 2, the cap 13 is separated here from the container 2. In order to use the now-exposed sawing region 22, the securing strip 23 illustrated in FIG. 1 is also separated away from the cap 13.

Figure 3:
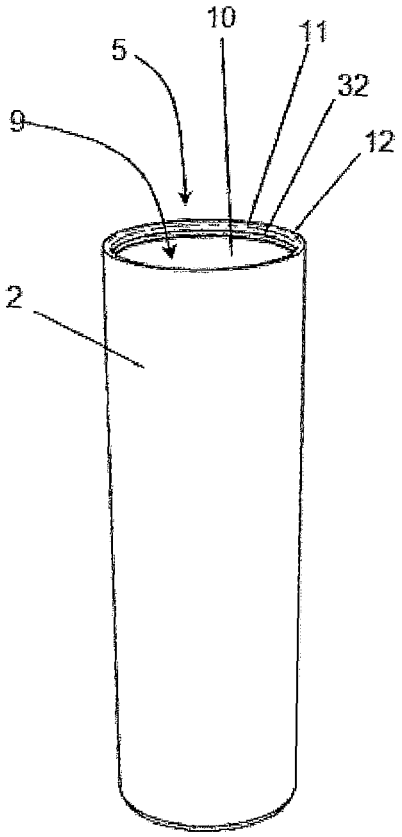
FIG. 3 illustrates a perspective view of the container of the administration unit from FIG. 1.

FIG. 3 illustrates a perspective view of the container 2 of the administration unit 1 from FIG. 1. FIG. 3 shows an opening 5 of the container that allows access to the space 9 of the container 2, in which the composition is located. Said opening 5 was still covered by the cap 13 in FIG. 1. The opening 5 is delimited by a margin 12, wherein there is provided a bevel 11 that constitutes another combining aid and provides the ability to especially easily close the container 2 with the cap 13. The bevel 11 provides the transition to an inner wall 10 of the container 2 that encloses the space 9. Further provided on the inner wall 10 is a projection 32 that projects into the space 9 and is annular in shape. This projection 9 serves to fix the cap 13 onto the container 2 both in the storage position and in the separating position (described hereinafter).

Figure 4:
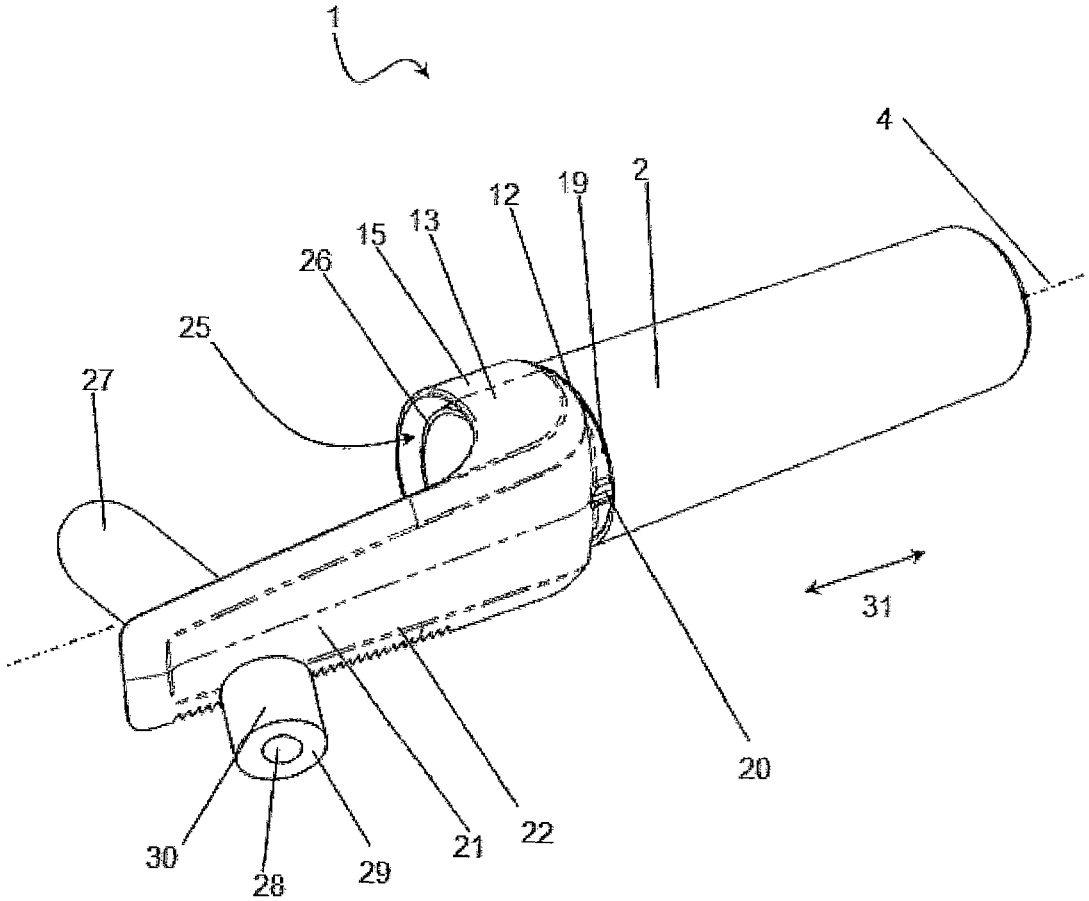
FIG. 4 illustrates a perspective view of the administration unit from FIG. 1, in the separating position.

FIG. 4 illustrates a perspective view of the administration unit 1 from FIG. 1 in the separating position, with which the user separates a portion 30 out from a kneadable composition 27 that has been removed from the space 9 of the container 2. With the portion 30, it is also possible to discern both components 28, 29 of the kneadable composition 27, wherein the second component 29 surrounds the first component 28. To provide the separating position, the mounting section 17 depicted in FIG. 1 is introduced through the opening 5 into the space 9 of the container 2, until the projecting stop element 20 rests on the margin 12. The stop element 20 thus delimits the insertion path of the mounting section 17. The combining aids, the bevel 18 of the cap 13, and the bevel 11 of the container 2 make it possible to ensure easy insertion of the mounting section 17. Thus, in particular, the mounting section 17, the opening 5, and the inner wall 10 serve as corresponding connecting regions in order to provide the separating position. Then, in particular, the mounting section 17 and the inner wall 10 may be designed so as to be able to provide a non-positive-locking connection. The embodiment depicted, however, uses a positive-locking connection technique, because the cap 13 is designed so that when the mounting section 17 is being inserted through the opening 5 into the space 9, the projection 9 of the container 2 engages or latches onto the collar region 19 of the cap 13 at the stepwise transition thereof into the mounting region 17, in order to enable fixation of the cap 13 into the separating position. The view depicted additionally shows the region of the cap 13 that is concealed by the overlap region 15 in FIG. 1, which region provides the ability to close the container 2 in the storage position. For this purpose, the cap 13 has a projecting annular continuation 26 that protrudes in the storage position through the opening 5 into the space 9 of the container 2, wherein it is possible to enable a seal between the continuation 26 and the inner wall 10. Parts of the casing of the container 2 then protrude in the storage position into an intermediate space 25 between the continuation 26 and the overlap region 15.

In the depicted arrangement of the cap 13 and the container 2 in the separating position, the surface portion 21 and thus also the sawing region 22 extend in the distal direction essentially parallel to the axis 4, and project out from the container 2. The user is thus provided with the ability to grip or guide the sawing region 22 with the container 2. For example, the user can enclose the container 2 in the power grip and separate a portion 30 out from the kneadable composition 27 by means of a sawing motion 31 of the administration unit 1, in parallel to the axis 4.

| List of reference signs: | |
|---|---|
| 1 | Administration unit |
| 2 | Container |
| 3 | Outer surface |
| 4 | Container axis |
| 5 | Opening |
| 6 | Upper side |
| 7 | Bottom |
| 8 | Underside |
| 9 | Space |
| 10 | Inner wall |
| 11 | Bevel |
| 12 | Margin |
| 13 | Cap |
| 14 | Curvature |
| 15 | Overlap region |
| 16 | Covering surface |
| 17 | Mounting section |
| 18 | Bevel |
| 19 | Collar region |
| 20 | Stop element |
| 21 | Surface portion |
| 22 | Sawing region |
| 23 | Securing strip |
| 24 | Connecting region |
| 25 | Intermediate space |
| 26 | Annular continuation |
| 27 | Kneadable composition |
| 28 | First component |
| 29 | Second component |
| 30 | Portion |
| 31 | Sawing motion |
| 32 | Projection |

What is claimed:

1. An administration unit for a composition, comprising:

a container for accommodating the composition and defining a center axis therethrough, the container having a first side defining an opening, a second side having a closed bottom, a midpoint axially equidistant between the first side and the second side defining a midpoint length from the first side to the midpoint and a container wall extending between the first side and the second side, the container having an exterior surface and an interior surface enclosing a cavity connected to the opening, a cap for closing the container opening and defining an axis therethrough, wherein the cap has a closed end, an edge defining an open end, an overlap region connecting the closed end and the open end, and a separating region projecting axially from one side of the overlap region and extending axially beyond the edge for at least a midpoint length, and mutually corresponding connection means on the container and cap, wherein in a first storage position the cap overlap region is disposed over the container first end and over the wall exterior surface to seal the container opening and the separating region extends alongside the wall exterior surface between the connection means and the container second end, and in a second separating position the cap closed end is disposed through the opening and into the cavity and the overlap region projects away from the container and the separating region projects away from the container.

2. The administration unit according to claim 1, wherein the connection means for the second separating position comprises a friction fit of a mounting section of the cap with the container interior surface.

3. The administration unit according to claim 2, wherein the mounting section has a shape corresponding to the opening.

4. The administration unit according to claim 2, wherein the mounting section has a shape corresponding to the opening and is designed so as to be insertable into the opening.

5. The administration unit according to claim 2, wherein the cap and/or the container comprises fastening means to provide a positive-locking and/or non-positive-locking connection between the cap and the container in the second separating position.

6. The administration unit according to claim 2, wherein the mounting section comprises a rounded-off or beveled region opposite the open end to facilitate insertion of the mounting section into the opening.

7. The administration unit according to claim 2, wherein the mounting section has a shape corresponding to the opening and the cap has a projecting stop means that is arranged and configured so as to limit the insertion of the mounting section into the opening.

8. The administration unit according to claim 1, wherein the cap closed end defines a cavity having an interior wall and closed end, the cavity being disposable over the container exterior surface at the second side.

9. The administration unit according to claim 1, wherein a protection section is injection-molded onto the separating region and the protection section can be removed from the separating region by a user prior to use of the separating region.

10. The administration unit according to claim 1, wherein the separating region comprises an axially extending edge including serrations thereon.

11. The administration unit according to claim 1, wherein the separating region comprises an axially extending edge including serrations thereon to define a sawing region and further comprising a removable protection section that covers the serrations.

12. The administration unit according to claim 1, wherein the separating region has distal edge and in the first storage position the separating region extends alongside the wall exterior surface and the distal edge is between the cap edge and the container second side.

13. The administration unit according to claim 1, wherein the separating region has distal edge and in the first storage position the distal edge is adjacent the container second side.

14. The administration unit according to claim 1, wherein the separating region is adapted for cutting a kneadable composition.

15. An administration unit for a composition, comprising:

a container for accommodating the composition and having a first side defining an opening, a second side having a closed bottom, and a container wall extending between the first side and the second side, the container having an exterior surface and an interior surface enclosing a cavity connected to the opening, a cap for closing the container opening, the cap having a closed end, an edge defining an open end, and an overlap region connecting the closed end and the open end, the cap defining an axis therethrough and a plane along the axis that bisects the cap, the cap including a separating region on only one side of the plane, the separating region projecting from the overlap region and extending axially to an edge, and mutually corresponding connection means on the container and cap, wherein in a first storage position the cap overlap region is disposed over the container first end and over the wall exterior surface to seal the container opening and the separating region extends alongside the wall exterior surface between the connection means and the container second end, and in a second separating position the cap closed end is disposed through the opening and into the cavity and the overlap region projects away from the container and the separating region projects away from the container.

16. The administration unit according to claim 15, wherein the separating region has a rectangular shape.

17. An administration unit for a composition, comprising:

a container for accommodating the composition and having a first side defining an opening, a second side having a closed bottom, and a container wall extending between the first side and the second side, the container having an exterior surface and an interior surface enclosing a cavity connected to the opening, a cap for closing the container opening and defining an axis therethrough, wherein the cap has a closed end, an interior surface, an exterior surface connecting the closed end to an exterior edge and defining an overlap region, and a separating region projecting axially from the overlap region to an end, the separating region having an interior surface connected to the cap interior surface, an exterior surface connected to the cap exterior surface and two axially extending edges bounding the separating region interior surface and exterior surface and connecting the separating region end to the overlap region, and mutually corresponding connection means on the container and cap, wherein in a first storage position the cap overlap region is disposed over the container first end and over the wall exterior surface to seal the container opening and the separating region extends alongside the wall exterior surface between the connection means and the container second end, and in a second separating position the cap closed end is disposed through the opening and into the cavity and the overlap region projects away from the container and the separating region projects away from the container.

18. The administration unit according to claim 17, wherein one separating region edge is a linear cutting edge.

* * * * *